US008655159B2

(12) United States Patent
Tai et al.

(10) Patent No.: US 8,655,159 B2
(45) Date of Patent: Feb. 18, 2014

(54) HEATING AND COOLING APPARATUS

(76) Inventors: Yung-Ming Tai, Tao-Yuan (TW); Edwin Ho, Irvine, CA (US)

( * ) Notice: Subject to any disclaimer, the term of this patent is extended or adjusted under 35 U.S.C. 154(b) by 359 days.

(21) Appl. No.: 13/049,170

(22) Filed: Mar. 16, 2011

(65) Prior Publication Data

US 2012/0219434 A1 Aug. 30, 2012

Related U.S. Application Data

(63) Continuation-in-part of application No. 13/035,016, filed on Feb. 25, 2011.

(51) Int. Cl.
*F24H 3/02* (2006.01)

(52) U.S. Cl.
USPC ..... 392/360

(58) Field of Classification Search
USPC ..... 219/386, 632; 415/53.1, 121.2, 125, 415/126, 127, 129, 184, 185, 186, 198.1, 415/203, 204, 206, 224; 416/79, 82, 98, 416/112, 114, 175, 178, 183, 187, 201 A, 416/203; 392/360
See application file for complete search history.

(56) References Cited

U.S. PATENT DOCUMENTS

| | | | | |
|---|---|---|---|---|
| 2,258,284 | A * | 10/1941 | Findley | 417/326 |
| 3,251,540 | A * | 5/1966 | Kinsworthy | 415/207 |
| 4,373,576 | A * | 2/1983 | Strupczewski | 165/48.1 |
| 7,473,078 | B2 * | 1/2009 | Hisaka et al. | 416/175 |
| 2009/0120925 | A1 * | 5/2009 | Lasko | 219/386 |

* cited by examiner

*Primary Examiner* — Dana Ross
*Assistant Examiner* — Joseph Iskra
(74) *Attorney, Agent, or Firm* — Frank Marino

(57) ABSTRACT

As exemplified, a portable air blowing appliance includes a housing retaining an airflow-producing electric motor-driven blower. The blower is adapted when energized for operation in either a first or a different mode. An electric heating element is adapted when energized to expel heat. An electric switch enables energizing of the blower and the heating element to either cause operation of the blower in the first mode or to cause, simultaneously, operation of the blower in the different mode and heat expulsion by the heating element. The blower is adapted for higher airflow-producing efficacy during the first mode. The heating element is disposed to warm airflow from the blower during the different mode.

12 Claims, 9 Drawing Sheets

HEATING AND COOLING APPARATUS

RELATED APPLICATION

This application is a Continuation-In-Part of pending U.S. Utility patent application Ser. No. 13/035,016, Filed on Feb. 25, 2011, the entirety of which is incorporated herein by reference.

FIELD OF THE INVENTION

This invention relates to household heaters, fans and blowers, and more specifically, to such portable appliances adapted for selectably directing either a warm or cool airflow into the surrounding environment.

BACKGROUND OF THE INVENTION

There is an ever-increasing need to obtain localized heating at home and in the work place. There is also an ever-increasing need to obtain localized cooling or ventilating air flow in those places. As costs rise and incomes fall in a declining economy, the need to obtain a variety of such functions in a single portable appliance becomes more and more advantageous.

Existing air blowing appliances typically prevail in two main types; axial fans and centrifugal blowers. Axial fans have an electric motor typically oriented such that its rotational axis is aligned with the direction of air movement. An air propeller affixed to the motor's rotor rotates about the axis and causes air to be pushed forwardly from the fan in the direction along the axis. Centrifugal blowers have an electric motor typically oriented such that its rotational axis is perpendicular to the direction of air movement. A blower wheel affixed to the motor's rotor rotates about the axis and causes air to be pulled into the wheel, and then pushed outwardly and forwardly from the appliance.

Blower wheels include a plurality of peripherally disposed vanes, which rotate concentrically about the wheel's axis as the blade rotates. Such vanes are sometimes straight, and extend radially from the wheel's axis as spokes from a wheel. Such straight, radially-disposed vanes cause the wheel to be equally efficient in either rotational direction, hence, optimal in neither. Such wheels are useful in reversible blowers for causing an equal airflow in either direction, although less than optimal in both, according to the rotational direction of the wheel.

In order to optimize airflow from a centrifugal blower wheel, the vanes are typically curved into the direction of the wheel's rotation to increase air-producing efficacy. Curvature opposite to such a "directional" wheel's rotation results in a loss of efficacy, and a less voluminous and more turbulent airflow. So that a wheel that is optimized for say the clockwise (right-handed) rotational direction, would have vanes that curve to the right as they extend from the wheel's axis, and would produce airflow efficiently when the wheel is rotated clockwise. But such a wheel would produce a less voluminous and more turbulent airflow is the wheel's rotational direction was reversed to counter-clockwise. It has therefore been inconceivable to date that a directional blower wheel would be useful in a reversible application.

Certain electrical air heaters also incorporate such a blower wheel along with a heating element. Air is pushed or pulled through the element to be warmed before it exits the appliance. While airflows from cooling appliances are preferably made high to cause a "wind chill" effect when the airflow impacts the user, airflows are preferably made low from air heaters to avoid such an effect, which would contradict their intended warming function.

Variable air flow rates from centrifugal blowers are typically achieved by variation of the motor speed, either by using a speed controller or by including a multitude of taps into the motor coil, either of which adds cost, complexity, and an additional opportunity for failure compared to a single speed blower.

There exists the need for an efficient portable air blowing appliance which selectively provides cooling at a higher airflow, and warming at a lower airflow and such is an object of the present invention.

There exists the need for such an appliance which selectively provides either airflow without the need for a speed controller, and such is an object of the present invention.

There exists the need for such an appliance which selectively provides either airflow without the need for a multiple-speed motor, and such is an object of the present invention.

There exists the need for such an appliance which selectively provides either airflow without the need for multiple motor coils or taps, and such is an object of the present invention.

Other needs and objects will become apparent upon a reading of the following disclosure in combination with the appended drawings.

SUMMARY OF THE INVENTION

According to the exemplary embodiment disclosed and described herein, the invention may be embodied as a portable air blowing appliance having a housing retaining an airflow-producing blower, the blower adapted for operation in either a first or a different mode. A selector enables operation of the blower in either the first or the different mode. A heating element is adapted when energized to heat airflow produced by the blower. The blower causes a first airflow into and from the housing, and the heating element is not energized, during the first mode, and the blower causes a different airflow into and from the housing, and the heating element is energized to warm the different airflow, during the different mode.

The exemplary blower includes a motor-driven centrifugal blower wheel rotatable about a blower axis to cause the first and different airflows. While the invention should be encompassed in a mirror-image appliance having an opposite blower rotational direction and opposite airflow paths, the disclosed blower wheel rotates in a right-handed direction in the first mode to cause the first airflow, and in a left-handed direction in the different mode to cause the different airflow. The blower wheel is a "directional" right-handed blower wheel, and is thereby adapted to cause the first airflow to be more voluminous than the different airflow. The heating element may be disposed, as depicted, in the different airflow. The housing may have first and second frontal vents, wherein during the first mode, the first frontal vent is an intake vent for receiving outside air pulled by the blower into the housing and the second frontal vent is an exhaust vent for allowing air from the blower to exit the housing there-through; and wherein during the different mode, the second frontal vent is an intake vent for receiving outside air pulled by the blower into the housing and the first frontal vent is an exhaust vent for allowing air from the blower to exit the housing there-through.

The heating element is preferably disposed aerodynamically downstream of the blower during the different mode, but may less preferably be disposed upstream. The heating element is also preferably disposed adjacent the first frontal vent such that the different airflow is warmed thereby as the different airflow exits through the first frontal vent.

The heating element is preferably an electrical heating element and the selector is preferably an electrical switch having a first position and a second position. During the first position, the switch causes the blower to operate in the first mode; and conversion of the switch to the second position causes the blower to operate in the different mode and causes energization of the heating element.

While the rotational direction may be opposite in a mirror-image arrangement, because the blower wheel rotates in the left-handed direction in the exemplary embodiment disclosed, the first frontal vent is disposed on the front left side of the housing and the second frontal vent is disposed on the front right side of the housing.

The invention may also be embodied, as exemplarily embodied herein, as a portable air blowing appliance having a housing, an airflow-producing electric motor-driven blower retained by the housing and adapted for operation in first and different modes, an electric switch for causing operation of the blower in either the first or the different mode, and an electric heating element adapted when energized to heat airflow produced by the blower, wherein the blower causes a first airflow into and from the housing, and the heating element is not energized, during the first mode, and the blower causes a different airflow into and from the housing, and the heating element is energized to warm the different airflow, during the different mode.

The blower may include a centrifugal blower wheel rotatable about a vertical blower axis to cause the first and different airflows, wherein the blower wheel rotates in one of a right-handed direction and a left-handed direction in the first mode to cause the first airflow, and in the other of the right-handed direction and the left-handed direction in the different mode to cause the different airflow.

The blower wheel may be adapted, such as by the vane curvature of the exemplary embodiment, for higher airflow-producing efficacy when rotating in the one of the right-handed and the left-handed directions, to cause the first airflow to be more voluminous than the different airflow. The heating element may be disposed in the different airflow.

The housing may include left and right frontal vents, wherein during the first mode, one of the left and right frontal vents is an intake vent for receiving outside air pulled by the blower into the housing and the other of the left and right frontal vents is an exhaust vent for allowing air from the blower to exit the housing there-through, and wherein during the different mode, the other of the left and right frontal vents is an intake vent for receiving outside air pulled by the blower into the housing and the one of the left and right frontal vents is an exhaust vent for allowing air from the blower to exit the housing there-through.

The heating element may be disposed aerodynamically downstream of the blower during the different mode. The heating element may be disposed adjacent the one of the left and right frontal vents such that the different airflow is warmed thereby as the different airflow exits through the one of the left and right frontal vents. The heating element may be an electrical heating element and the selector may an electrical switch having a first position and a second position. During the first position the switch may cause the blower to operate in the first mode, and during the second position the switch may cause the blower to operate in the different mode and may cause energization of the heating element.

When the other of the right-handed direction and the left-handed direction is the left-handed direction, as exemplarily embodied herein, the one of the left and right frontal vents is preferably the left frontal vent and the other of the left and right frontal vents is preferably the right frontal vent.

The invention may also be embodied in a portable air blowing appliance having an upright elongate housing supported on a stationary base and pivotable relative thereto, the housing and base engaged together through an oscillation motor adapted for selectably causing oscillatory movement of the housing relative to the base. An airflow-producing electric motor-driven blower is retained by the housing and adapted when energized for operation in either a first or a different mode, the blower including an elongate centrifugal blower wheel rotating about a vertical blower axis in a first direction during the first mode and rotating about the vertical blower axis in a second direction, opposite the first direction, during the different mode.

An electric heating element is adapted when energized to expel heat. An electric switch is provided for selectably energizing the blower and the heating element to either cause operation of the blower in the first mode or to cause, simultaneously, operation of the blower in the different mode and heat expulsion by the heating element.

The blower wheel is adapted, such as by vane curvature as disclosed, for higher airflow-producing efficacy when rotating in the first direction, to cause a first airflow in the first mode a less voluminous different airflow in the different mode. The heating element is disposed in the different airflow to warm the less voluminous different airflow during the different mode.

The housing includes left and right frontal vents. During the first mode, one of the left and right frontal vents is an intake vent for receiving outside air pulled by the blower into the housing and the other of the left and right frontal vents is an exhaust vent for allowing air from the blower to exit the housing there-through. During the different mode, the other of the left and right frontal vents is an intake vent for receiving outside air pulled by the blower into the housing and the one of the left and right frontal vents is an exhaust vent for allowing air from the blower to exit the housing there-through. The heating element is disposed adjacent the one of the left and right frontal vents such that the different airflow is warmed by the heat expelled there-from as the different airflow exits through the one of the left and right frontal vents.

Additional aspects of the invention can be appreciated upon perusal of the following detailed description of an exemplary air blower according to the invention along with the accompanying drawings. The components in the drawings are not necessarily to scale, emphasis instead being placed upon clearly illustrating the principles of the invention. Moreover, in the drawings, like reference numerals designate corresponding parts throughout the several views.

DETAILED DESCRIPTION OF THE INVENTION

Figure 1:
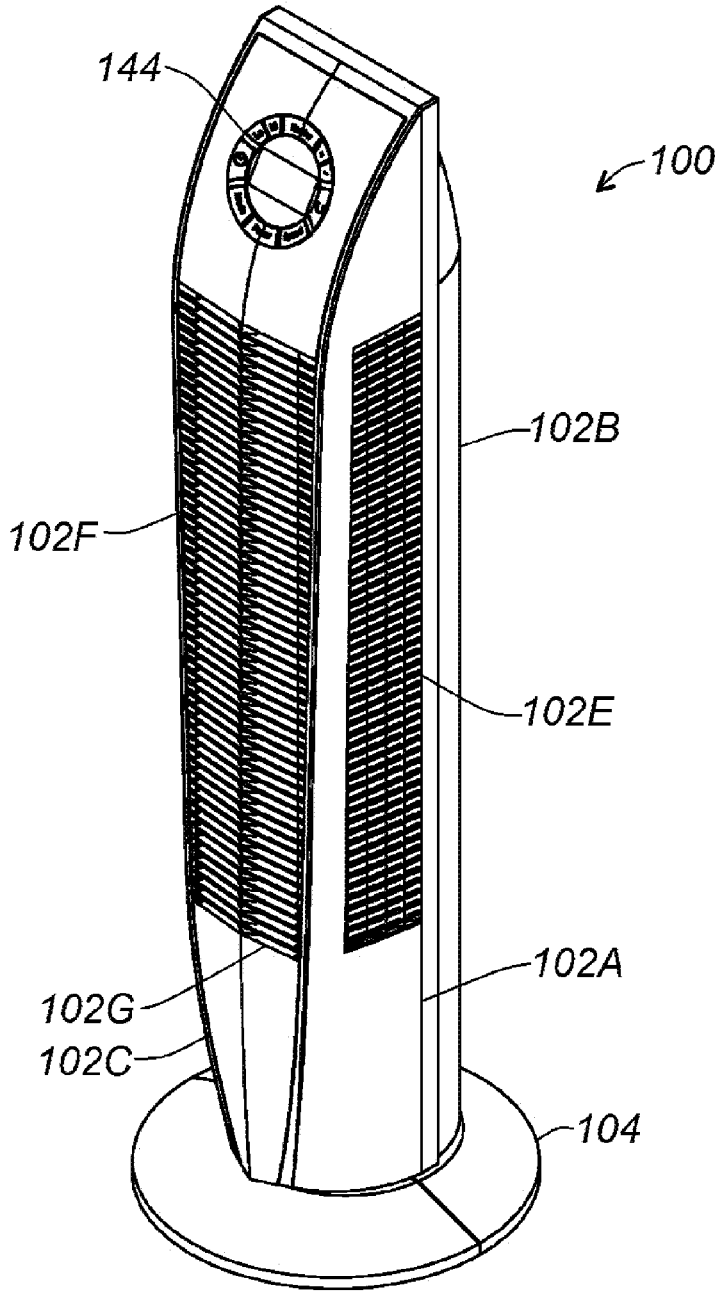
FIG. 1 is a perspective view of a portable air blowing appliance in accordance with an exemplary embodiment of the invention.
Figure 2:
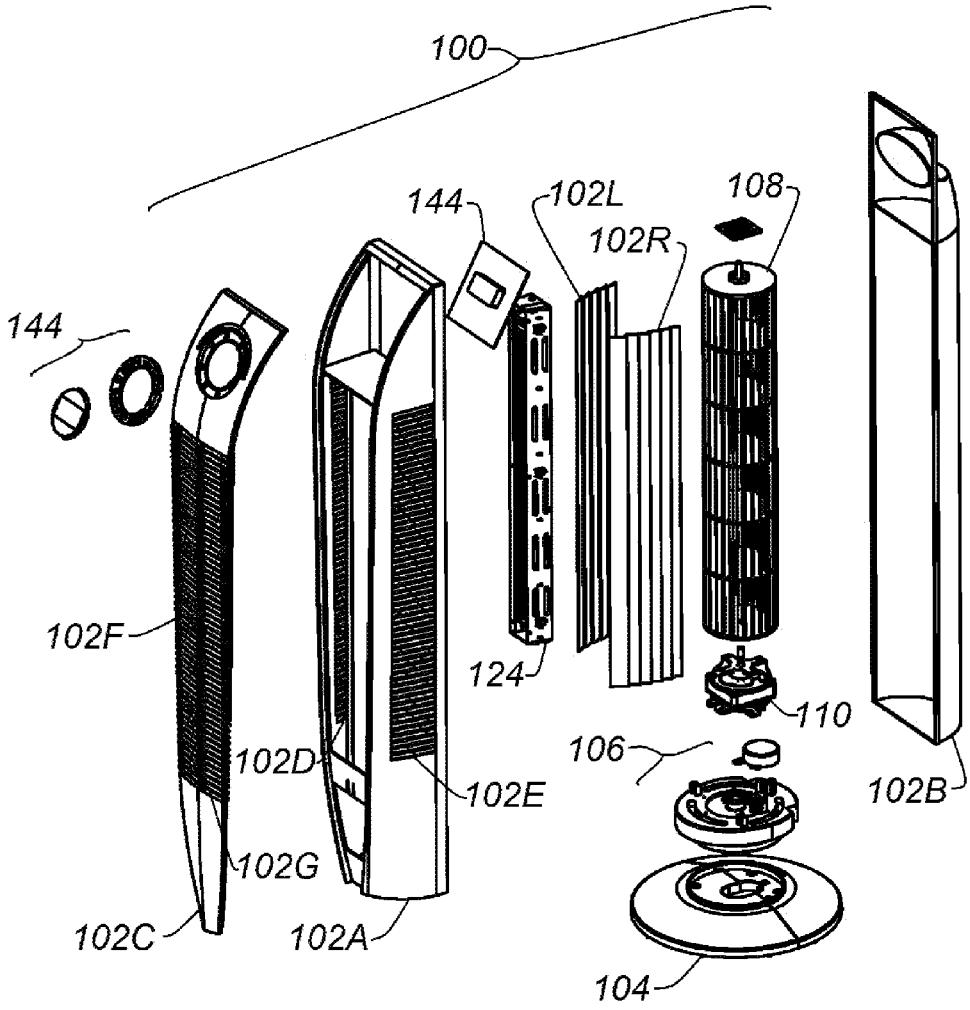
FIG. 2 is an exploded view of the appliance of FIG. 1.
Figure 3:
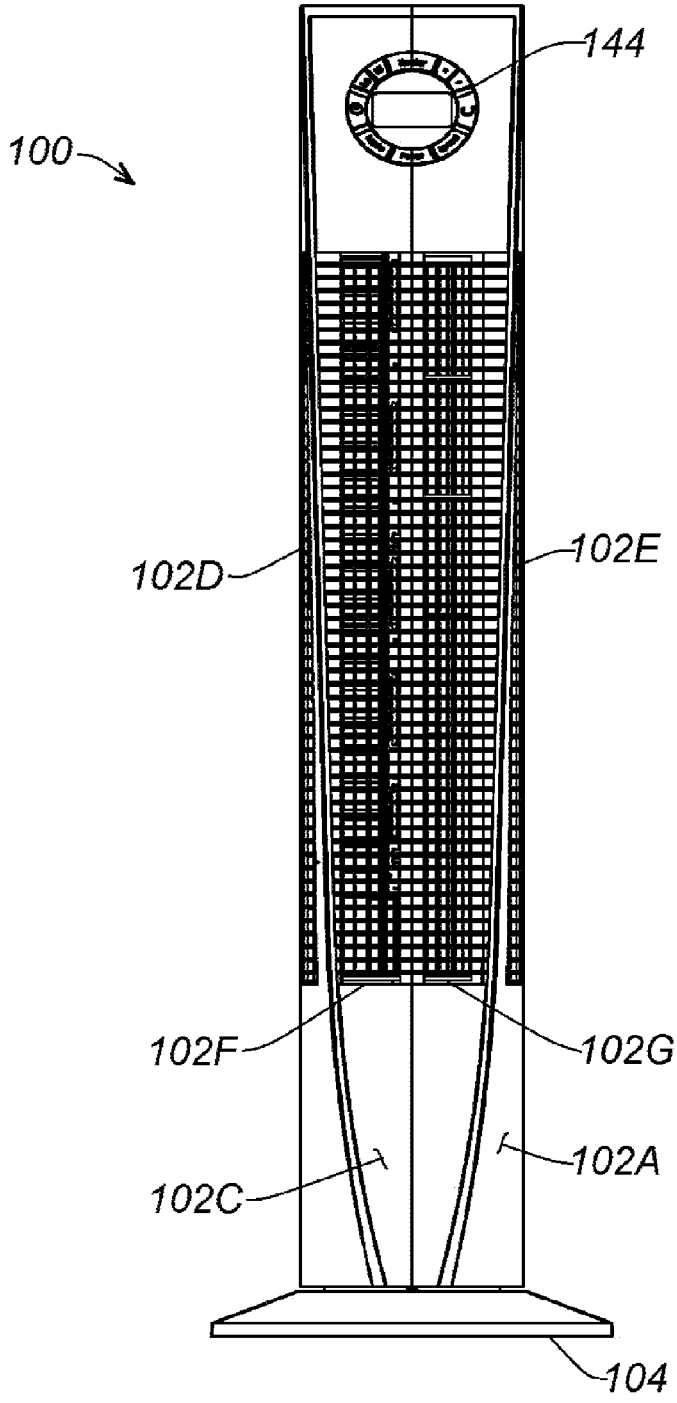
FIG. 3 is a view of the front of the appliance of FIG. 1.
Figure 4:
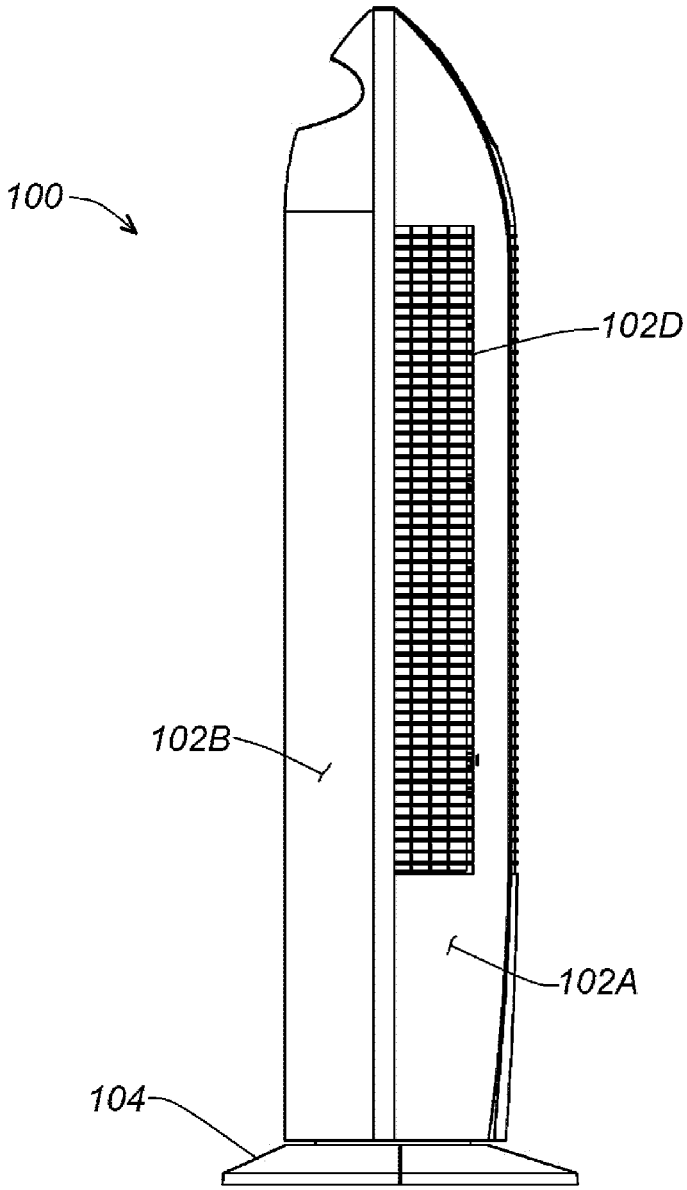
FIG. 4 is a view of the right side of the appliance of FIG. 1.
Figure 5:
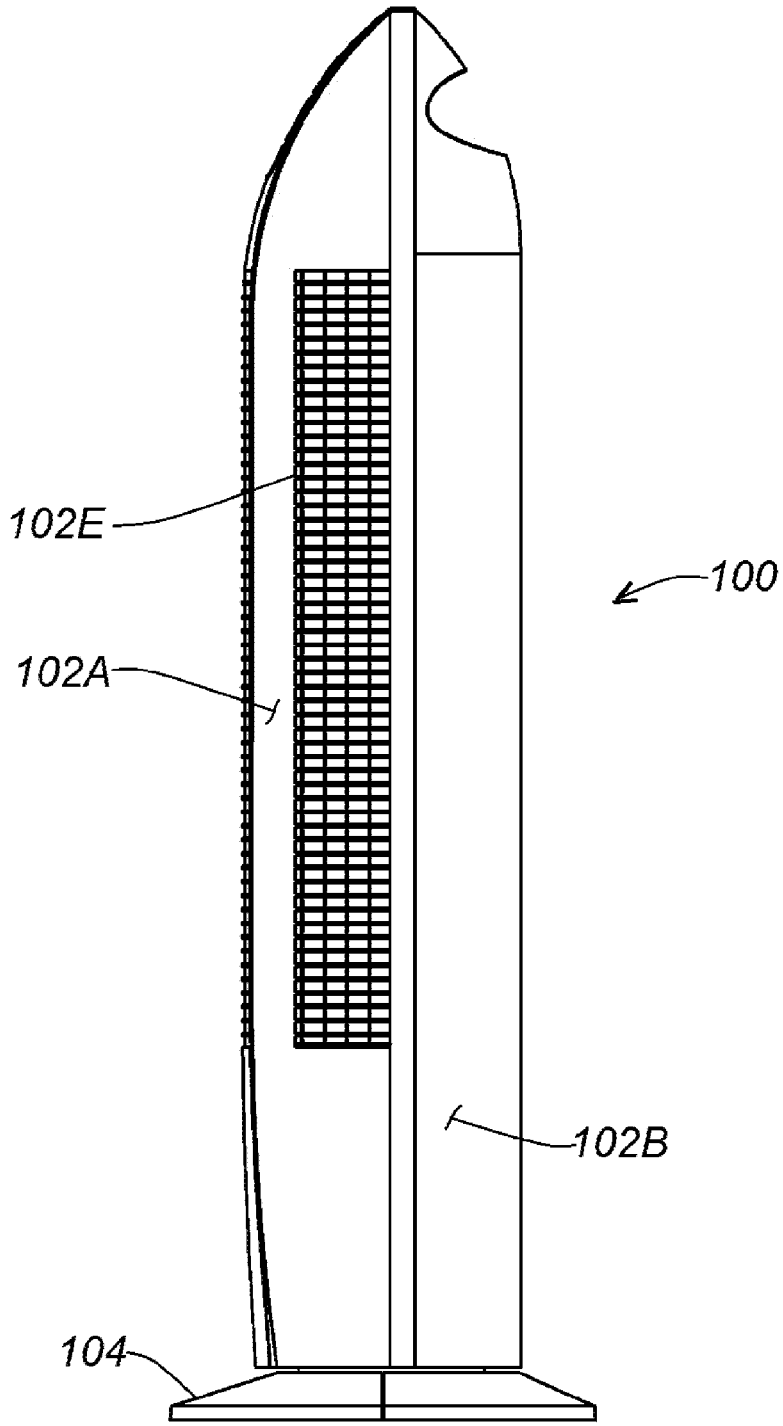
FIG. 5 is a view of the left side of the appliance of FIG. 1.
Figure 6:
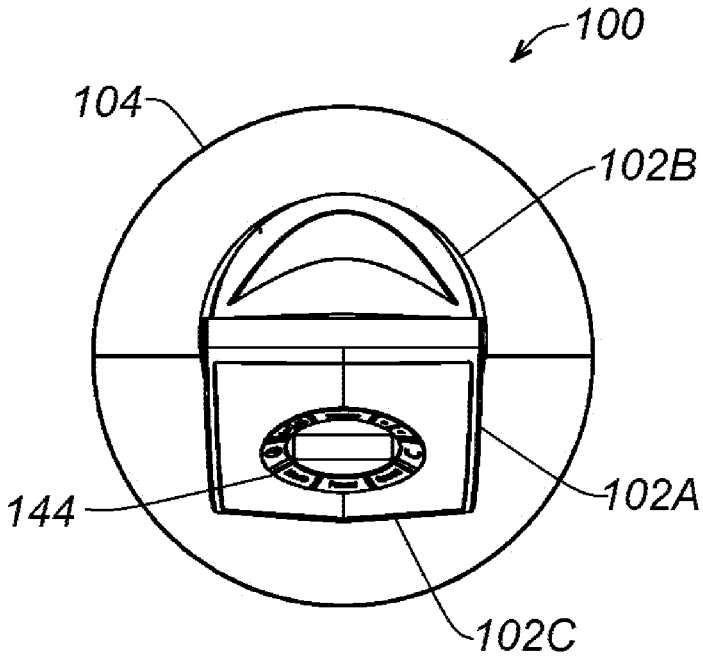
FIG. 6 is a view of the top of the appliance of FIG. 1.
Figure 7:
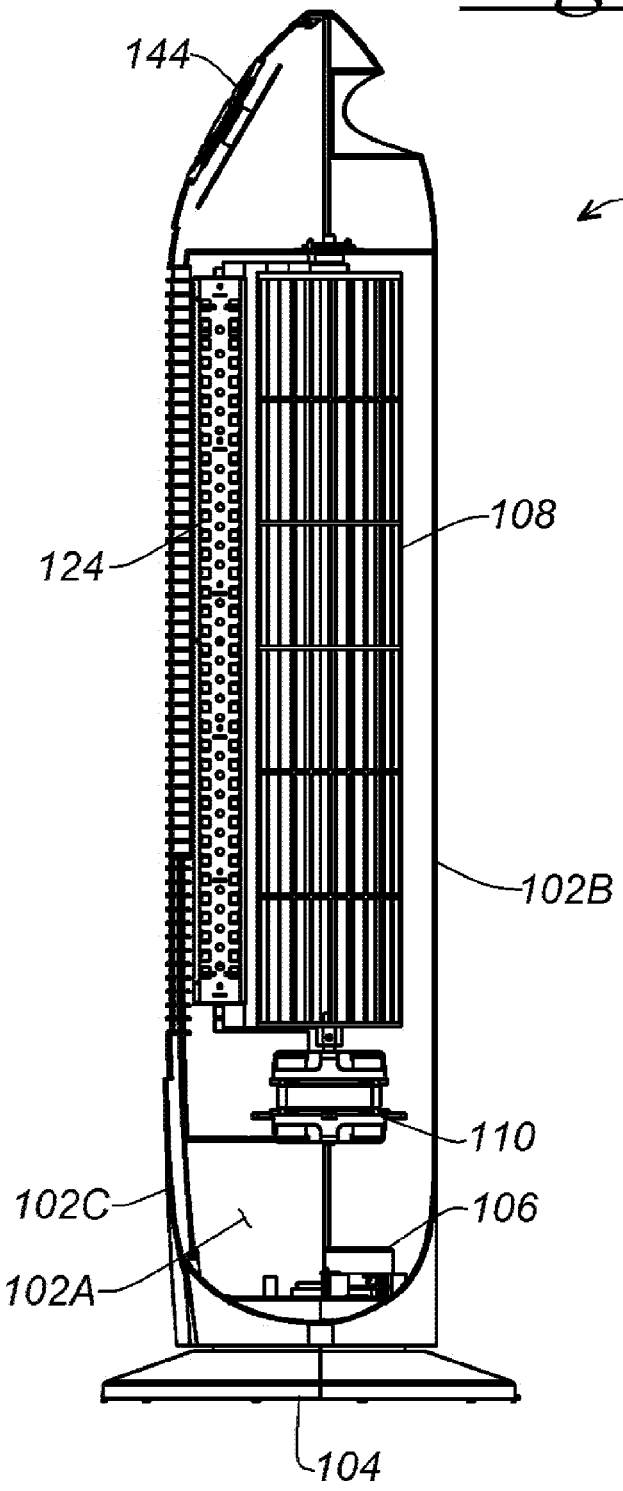
FIG. 7 is a cross-sectional side view of the appliance of FIG. 1.

FIGS. 1-9 illustrate a portable air blowing appliance 100 according an exemplary embodiment of the present invention. The appliance includes a housing and a base 104, connected by a motorized oscillation arrangement 106. The housing is made of front cover 102A, rear cover 102B, front grill plate 102C, left side louver director 102L, and right side louver 102R.

Front cover 102A includes left side grill 102D and right side grill 102E, which are adapted to cooperate with the left and right side louvers, respectively, to form air intakes as will be later explained. Front grill plate 102C includes left front grill 102F and right front grill 102G to form either air intakes or exhausts as will be later explained.

The components of the elongate housing are assembled around, and form a scroll around blower wheel 108, which is connected to and rotatable by electric blower motor 110. Integrally formed into front cover 102A is cutoff wall 102H, which guides air into and from the blower wheel as it is rotated.

Figure 8:
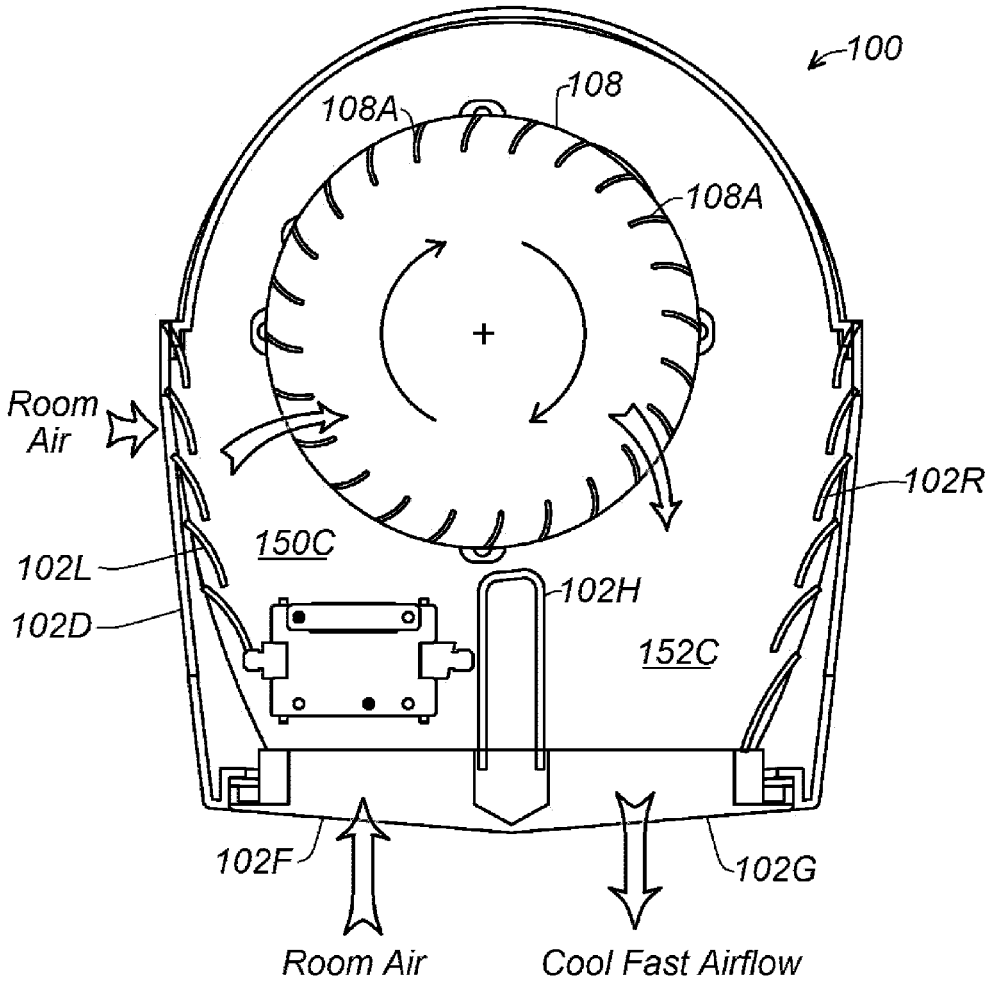
FIG. 8 is a cross-sectional top view of the appliance of FIG. 1 in its cooling mode.

As seen best in FIG. 8, the appliance can serve as an efficient and high-powered cooler when clockwise (right-handed) rotation of the blower wheel within the surrounding housing causes air to be sucked into the wheel through left front grill 102F and non-energized heating element 124 and to be forced centrifugally from the wheel to be directed by the housing and blown forwardly from the appliance through front right grill 102G.

Because the blower wheel has vanes 108A which curve with the right-handed rotation, the wheel is a "right-handed" wheel, and is efficient and powerful in moving air as shown in FIG. 8, during the appliance's cooling mode. Left side intake grill 102D and left side louver 102L cooperate to allow outside air to pass there-through into the vacuum side 150C of the appliance's interior because left side louver 102L is shaped to correspond to the desired flow of the air incoming there-through. But right side louver 102R is shaped to interfere with the outflow of air there-through on the pressure side 152C of the appliance's interior, so all of the airflow being generated by the blower is forced out through the right front grill 102G. It can be seen that in this cooling mode, the left side grill/left side louver combination, and the left front grill, serve as intake openings to feed air to the blower wheel, while only the right front grill serves and an exhaust opening, to allow blown air to exit from and forwardly of appliance as a high-volume cool airflow.

Figure 9:
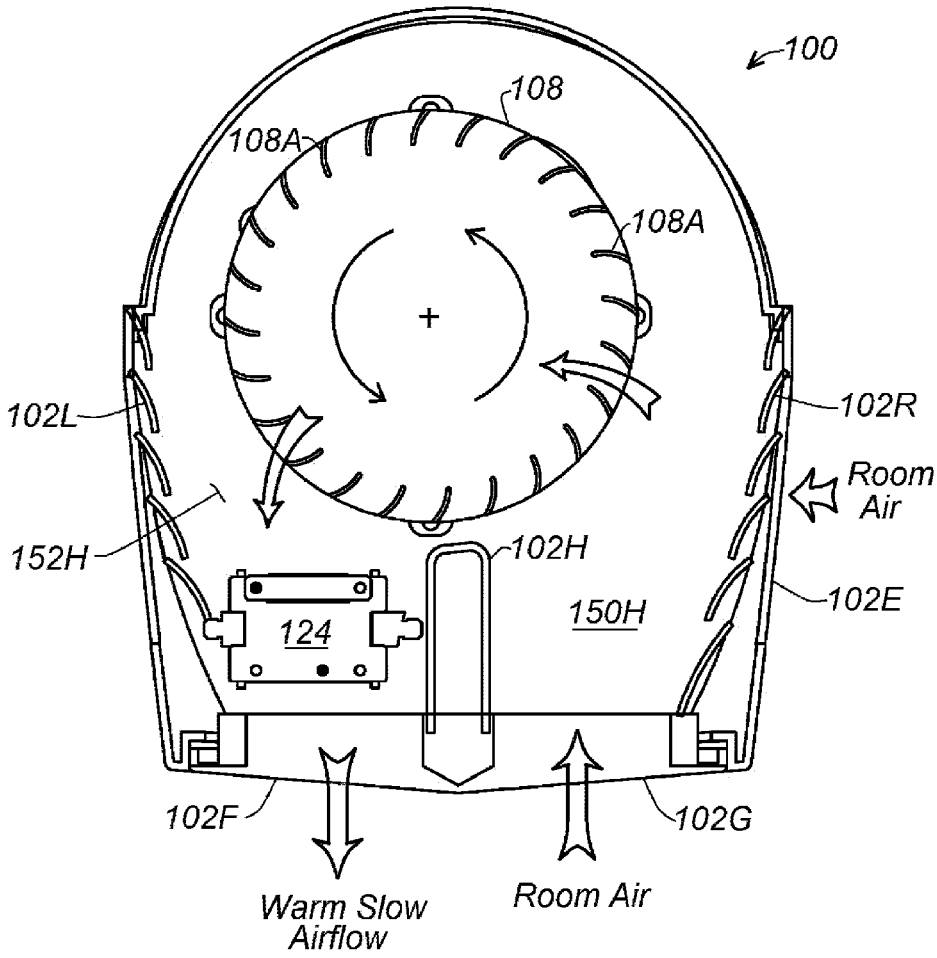
FIG. 9 is a cross-sectional top view of the appliance of FIG. 1 in its warming mode.

Referring now to FIG. 9, the appliance can serve as an effective air heater when counter-clockwise (left-handed) rotation of the blower wheel within the surrounding housing causes air to be sucked into the wheel through right front grill 102G and to be forced more turbulently and less voluminously from the wheel to be directed by the housing and blown forwardly through energized heating element 124 and from the appliance through left right grill 102F.

Because the blower wheel has vanes 108A which curve opposite to the left-handed rotation, the wheel, as previously stated, is a "right-handed" wheel, and is inefficient and less powerful in moving air as shown in FIG. 9, during the appliance's warming mode. Right side intake grill 102E and right side louver 102R cooperate to allow outside air to pass there-through into the vacuum side 150H of the appliance's interior because right side louver 102R is shaped to correspond to the desired flow of the air incoming there-through. But left side louver 102L is shaped to interfere with the outflow of air there-through on the pressure side 152H of the appliance's interior in this mode, so all of the airflow being generated by the blower is forced through the heating element and out through the left front grill 102F. It can be seen that in this warming mode, the right side grill/right side louver combination, and the right front grill, serve as intake openings to feed air to the blower wheel, while only the left front grill serves and an exhaust opening, to allow blown air to be heated by the energized heating element and exit from and forwardly of appliance as a lower-volume warm airflow.

The airflow from the right-handed blower wheel rotating right-handedly during the cooling mode of FIG. 8 has a relatively high volume and velocity, ideal for providing a cooling wind during, for instance, warm summer months. The slower and more turbulent airflow from the right-handed blower wheel rotating left-handedly during the heating mode of FIG. 9 has a relatively low volume and velocity, ideal for maximizing heat absorption as the blown air passes through the energized heating element, to provide a cooling breeze during, for instance, cold winter summer months.

Activation of the motorized oscillation mechanism 106 causes the housing to swing in an oscillatory fashion back and forth relative to the stationary base 104 to enable the distribution of this cooling airflow over a wide angle. Or de-activation of this oscillation allows the cooling airflow to be constantly directed at the same area. Such activation and de-activation, along with control of other electrical functions, such as energization of either the blower motor 110 in the right-handed direction during the cooling mode or energization of the heating element and the blower motor in the left-handed direction during the heating mode, are accomplished by switches and controls disposed at the control panel 144. Functions which may be provided and controlled from this panel may include; appliance on/off, oscillation on/off, thermostatic control, timer, adjustments of the heating element power, and adjustments to the blower speed.

From the foregoing, it will be clear that the present invention has been shown and described with reference to a preferred embodiment that merely exemplifies the broader invention revealed herein. Certainly, those skilled in the art can conceive of alternative embodiments. For instance, those with the major features of the invention in mind could craft embodiments that incorporate one or more major features while not incorporating all aspects of the foregoing exemplary embodiment. Obviously, many modifications and variations of the present invention are possible in light of the above teachings. It is to be understood, therefore, that the invention can be practiced otherwise than as specifically described. With this in mind, the claims that follow will define the scope of protection to be afforded the invention, and those claims shall be deemed to include equivalent constructions insofar as they do not depart from the spirit and scope of the present invention. Certain of these claims may express certain elements as a means for performing a specific function, at times without the recital of structure or material. As the law demands, any such claims shall be construed to cover not only the corresponding structure and material expressly described in the specification but also equivalents thereof.

We claim:

1. A portable air blowing appliance comprising:

a housing comprising a front face having adjacent first and second forwardly-facing vents;

an airflow-producing blower retained by the housing and adapted by rotation of a centrifugal blower wheel to pull a first airflow through the first forwardly facing vent and to push the first airflow through the second forwardly facing vent, and wherein the blower is further adapted by reverse rotation of the centrifugal blower to pull an alternative airflow through the second forwardly facing vent and push the alternative airflow through the first forwardly facing vent;

a selector for causing one or the other of the rotation of the centrifugal blower wheel to cause the first airflow or the reverse rotation of the centrifugal blower wheel to cause the alternative airflow;

a heating element disposed within the first or alternative airflows at the first forwardly facing vent and adapted when energized to heat airflow produced by the blower;

wherein the heating element is not energized when the selector causes the rotation of the centrifugal blower wheel; and the heating element is energized to warm the alternative airflow at the first vent when the selector causes the reverse rotation of the centrifugal blower wheel; and wherein during both the rotation and the reverse rotation air is pulled from forward of the housing and pushed forwardly from the housing.

2. The portable air blowing appliance of claim 1 wherein the centrifugal blower wheel is rotatable about a blower axis to cause the first and alternative airflows; and wherein the blower wheel rotates in one of a right-handed direction and a left-handed direction to cause the first airflow, and in the other of the right-handed direction and the left-handed direction to cause the alternative airflow.

3. The portable air blowing appliance of claim 2 wherein the blower wheel is adapted to cause the first airflow to be more voluminous than the alternative airflow.

4. The portable air blowing appliance of claim 1 wherein the heating element is an electrical heating element and the selector is an electrical switch having a first position and a second position;

wherein during the first position, the switch causes the rotation; and conversion of the switch to the second position causes the reverse rotation and causes energization of the heating element.

5. The portable air blowing appliance of claim 2, wherein when the other of the right-handed direction and the left-handed direction is the left-handed direction, the first forwardly-facing vent is disposed on the left side of the front face and the second forwardly-facing vent is disposed on the right side of the front face.

6. A portable air blowing appliance comprising:

an elongate vertically-disposed housing comprising a front face having adjacent first and second forwardly-facing vents;

an elongate vertically-disposed airflow-producing electric motor-driven blower retained by the housing and adapted by rotation of a centrifugal blower wheel to pull a first airflow through the first forwardly facing vent and to push the first airflow through the second forwardly facing vent, and wherein the blower is further adapted by reverse rotation of the centrifugal blower to pull an alternative airflow through the second forwardly facing vent and push the alternative airflow through the first forwardly facing vent;

an electric switch for causing one or the other of the rotation of the centrifugal blower wheel to cause the first airflow or the reverse rotation of the centrifugal blower wheel to cause the alternative airflow;

an electric heating element disposed within the first or alternative airflows at the first forwardly facing vent and adapted when energized to heat airflow produced by the blower;

wherein the heating element is not energized when the selector causes the rotation of the centrifugal blower wheel; and the heating element is energized to warm the alternative airflow at the first vent when the selector causes the reverse rotation of the centrifugal blower wheel; and wherein during both the rotation and the reverse rotation air is pulled from forward of the housing and rushed forwardly from the housing.

7. The portable air blowing appliance of claim 6 wherein the centrifugal blower wheel is rotatable about a vertical blower axis to cause the first and different airflows; and wherein the blower wheel rotates in one of a right-handed direction and a left-handed direction to cause the first airflow, and in the other of the right-handed direction and the left-handed direction to cause the alternative airflow.

8. The portable air blowing appliance of claim 1 wherein the blower wheel is adapted for higher airflow-producing efficacy when rotating in the one of the right-handed and the left-handed direction, to cause the first airflow to be more voluminous than the alternative airflow.

9. The portable air blowing appliance of claim 7 wherein the heating element is an electrical heating element and the selector is an electrical switch having a first position and a second position; and wherein during the first position, the switch causes the rotation; and during the second position, the switch causes the reverse rotation and causes energization of the heating element.

10. The portable air blowing appliance of claim 9 wherein when the other of the right-handed direction and the left-handed direction is the left-handed direction, the one of the left and right forwardly-facing vents is the left forwardly-facing vent and the other of the left and right forwardly-facing vents is the right forwardly-facing vent.

11. A portable air blowing appliance comprising:

an upright elongate housing, supported on a stationary base and pivotable relative thereto, the housing and base engaged together through an oscillation motor adapted for selectably causing oscillatory movement of the housing relative to the base, the housing comprising a front face having adjacent first and second forwardly-facing vents;

an elongate vertically-disposed airflow-producing electric motor-driven blower retained by the housing and adapted by rotation of a centrifugal blower wheel to pull a first airflow through the first forwardly facing vent and to push the first airflow through the second forwardly facing vent, and wherein the blower is further adapted by reverse rotation of the centrifugal blower to pull an alternative airflow through the second forwardly facing vent and push the alternative airflow through the first forwardly facing vent the blower comprising the elongate centrifugal blower wheel rotating about a vertical blower axis in a first direction during the rotation and rotating about the vertical blower axis in a direction opposite the first direction, during the reverse rotation; and an electric heating element adapted when energized to expel heat;

an electric switch for selectably energizing the blower and the heating element to either cause the rotation of the blower or to cause, simultaneously, the reverse rotation of the blower and heat expulsion by the heating element; wherein the blower wheel is adapted for higher airflow-producing efficacy during the rotation to cause a first airflow from the front face, a less voluminous alternative airflow from the front face during the reverse rotation, and the heating element is disposed in the alternative airflow to warm the less voluminous alternative airflow; and wherein the first airflow from the front face and the alternative airflow from the front face both flow forwardly from the front face and pull air from forward of the housing.

12. The portable air blowing apparatus of claim 11 wherein during the rotation, one of the left and right forwardly-facing vents is an intake vent for receiving outside air pulled by the blower into the housing and the other of the left and right forwardly-facing vents is an exhaust vent for allowing air from the blower to exit the front face there-through; and wherein during the reverse rotation, the other of the left and right vents is an intake vent for receiving outside air pulled by the blower into the housing and the one of the left and right forwardly-facing vents is an exhaust vent for allowing air from the blower to exit the front face there-through; and the heating element is disposed adjacent the one of the left and right forwardly-facing vents such that the alternative airflow is warmed by the heat expelled there-from as the alternative exits through the one of the left and right forwardly-facing vents.

* * * * *